US011196220B2

(12) United States Patent
Tu et al.

(10) Patent No.: US 11,196,220 B2
(45) Date of Patent: Dec. 7, 2021

(54) ELECTRICAL CONNECTOR

(71) Applicant: Lintes Technology Co., Ltd, New Taipei (TW)

(72) Inventors: Jin Yi Tu, New Taipei (TW); Shih Chi Kuan, New Taipei (TW); Yu Chien Lin, New Taipei (TW)

(73) Assignee: LINTES TECHNOLOGY CO., LTD, New Taipei (TW)

( * ) Notice: Subject to any disclaimer, the term of this patent is extended or adjusted under 35 U.S.C. 154(b) by 80 days.

(21) Appl. No.: 16/883,105

(22) Filed: May 26, 2020

(65) Prior Publication Data

US 2021/0021087 A1 Jan. 21, 2021

(30) Foreign Application Priority Data

Jul. 18, 2019 (CN) ..... 201910693159.9

(51) Int. Cl.
*H01R 13/6591* (2011.01)
*H01R 12/72* (2011.01)
*H01R 12/73* (2011.01)

(52) U.S. Cl.
CPC ..... *H01R 13/6591* (2013.01); *H01R 12/72* (2013.01)

(58) Field of Classification Search
CPC .. H01R 12/724; H01R 13/6582; H01R 12/73; H01R 13/11; H01R 13/46; H01R 13/516; H01R 13/648
See application file for complete search history.

(56) References Cited

U.S. PATENT DOCUMENTS 7,311,552 B1 * 12/2007 Ko ..... H01R 4/023 439/579
2008/0254683 A1 * 10/2008 Si ..... H01R 13/6594 439/607.41
2018/0090887 A1 * 3/2018 Little ..... H01R 13/6594

FOREIGN PATENT DOCUMENTS

CN 105576450 A 5/2016
TW M240698 U 8/2004

* cited by examiner

*Primary Examiner* — Jean F Duverne
(74) *Attorney, Agent, or Firm* — Locke Lord LLP; Tim Tingkang Xia, Esq.

(57) ABSTRACT

An electrical connector includes an insulating body having a mating slot, which has a first inner wall and a second inner wall facing each other vertically. A ground terminal is fixed to the insulating body, and has a first contact portion exposed on a higher surface of the first inner wall. A grounding member has a second contact portion and a third contact portion both exposed on a lower surface of the first inner wall. The second contact portion is located closer to the second inner wall relative to the higher surface. In a vertical direction, the third contact portion is located farther away from the second inner wall relative to the higher surface. The second contact portion is grounded and conductively connected to the first electrical component inside the mating slot to form a first ground loop. The first contact portion is conductively connected to the first ground loop.

18 Claims, 5 Drawing Sheets

A-A

B–B

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201910693159.9 filed in China on Jul. 18, 2019. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and particularly to an electrical connector reducing resonance.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A conventional electrical connector has an insulating body, having a mating slot used to accommodate a mating connector. The mating connector has a plurality of signal contacts and a plurality of ground contacts. A plurality of ground terminals and a plurality of pairs of signal terminals are fixed to the insulating body. The ground terminals and the pairs of signal terminals are alternately provided at intervals in a row. Each of the ground terminals is conductively connected to each of the ground contacts inside the mating slot. Each of the signal terminals is conductively connected to each of the signal contacts inside the mating slot. A metal member is fixed to the insulating body. The metal member has a plurality of elastic arms, and each of the elastic arms is correspondingly in contact with one of the ground contacts.

However, contact locations between the elastic arms as well as the ground terminals and the corresponding ground contacts are on a same plane, such that electromagnetic waves of the elastic arms and electromagnetic waves of the ground terminals easily resonate inside the mating slot, thereby affecting signal transmission of the electrical connector.

Therefore, a heretofore unaddressed need to design a new electrical connector exists in the art to address the aforementioned deficiencies and inadequacies.

SUMMARY

The present invention is directed to an electrical connector, in which at least one contact portion of a grounding member and a contact portion of a ground terminal are not located on a same horizontal plane, thereby adjusting resonance of the electrical connector.

To achieve the foregoing objective, the present invention adopts the following technical solutions.

An electrical connector is electrically connected to a first electrical component. The electrical connector includes: an insulating body, having a mating slot mated with the first electrical component, wherein the mating slot has a first inner wall and a second inner wall facing each other vertically, the first inner wall has a first surface and a second surface facing the second inner wall, and the first surface is located closer to the second inner wall relative to the second surface; a ground terminal, fixed to the insulating body, and having a first contact portion exposed on the first surface; and a grounding member, fixed to the insulating body, wherein the grounding member has a second contact portion and a third contact portion both exposed on the second surface, the second contact portion is located closer to the second inner wall relative to the first surface in a vertical direction, and the third contact portion is located farther away from the second inner wall relative to the first surface in the vertical direction; wherein the second contact portion is grounded and conductively connected to the first electrical component inside the mating slot to form a first ground loop, the first contact portion is conductively connected to the first ground loop, and the third contact portion is grounded and conductively connected to the first electrical component inside the mating slot to form a second ground loop.

In certain embodiments, the mating slot is forward mated with the first electrical component, the first surface is provided in front of the second surface, and the third contact portion, the second contact portion, and the first contact portion are sequentially provided at intervals in a front-rear direction.

In certain embodiments, the grounding member further has a fourth contact portion provided on the second inner wall, the fourth contact portion and the third contact portion are provided opposite to each other vertically inside the mating slot, and a distance between the third contact portion and the fourth contact portion is greater than a distance between the first contact portion and the second inner wall.

In certain embodiments, the ground terminal has a first contact arm extending forward, the first contact arm has the first contact portion, the grounding member has a second contact arm extending backward and located in front of the first contact arm correspondingly, the second contact arm has the second contact portion, and a length of the first contact arm is greater than a length of the second contact arm.

In certain embodiments, the grounding member has a third contact arm extending forward, the third contact arm has the third contact portion, and the length of the second contact arm is greater than a length of the third contact arm.

In certain embodiments, the grounding member has a connecting portion provided above the insulating body, the second contact arm extends backward from the connecting portion, the third contact arm extends forward from the connecting portion, the insulating body has a through slot running vertically therethrough and running downward through the first inner wall, the through slot is located below the connecting portion, and the second contact arm and the third contact arm passes downward through the through slot to be exposed on the second surface.

In certain embodiments, the electrical connector further includes a row of terminals, comprising a plurality of pairs of signal terminals and a plurality of ground terminals, wherein: the grounding member has a plurality of second contact arms, a plurality of third contact arms, and a plurality of connecting portions; the grounding member has a plurality of elastic portions arranged in a left-right direction, each of the elastic portions is formed by a corresponding second contact arm of the second contact arms, a corresponding third contact arm of the third contact arms, and a corresponding one of the connecting portions connecting the corresponding second contact arm and the corresponding third contact arm; and one of the ground terminals is provided behind each of the elastic portions, and a virtual extension line extending forward from one of the signal terminals is provided between each two of the elastic portions.

In certain embodiments, the grounding member is a metal shell wrapping the insulating body, the grounding member has an upper wall provided on an upper surface of the insulating body, the upper wall has a cavity running vertically therethrough, the elastic portions are provided inside the cavity in a row, a rear surface of the cavity extends forward to form a plurality of isolating portions, the elastic portions and the isolating portions are alternately provided in the left-right direction, and each of the isolating portions connects two adjacent ones of the connecting portions.

In certain embodiments, each of the isolating portions covers one of the pairs of signal terminals from above, and a distance between two adjacent ones of the isolating portions is less than a distance between two adjacent pairs of the pairs of signal terminals.

An electrical connector is electrically connected to a first electrical component. The electrical connector includes: an insulating body, having a mating slot opening forward to accommodate the first electrical component, wherein the mating slot has a first inner wall; a ground terminal, fixed to the insulating body and having a first contact arm partially exposed on the first inner wall to be grounded and conductively connected to the first electrical component; and a grounding member, fixed to the insulating body, wherein the grounding member has a second contact arm and a third contact arm both partially exposed on the first inner wall to be grounded and conductively connected to the first electrical component, the second contact arm and the third contact arm are provided in front relative to the first contact arm, and a length of the second contact arm is different from a length of the third contact arm.

In certain embodiments, the first contact arm has a first contact portion, the second contact arm has a first contact portion, the third contact arm has a third contact portion, each of the first contact portion, the second contact portion and the third contact portion is grounded and conductively connected to the first electrical component, the first contact portion and the second contact portion are located on a same horizontal plane, and the second contact portion and the third contact portion are located on different horizontal planes.

In certain embodiments, the mating slot further has a second inner wall, the first inner wall and the second inner wall are provided to face each other in a vertical direction, the first inner wall has a first surface and a second surface facing the second inner wall, the second surface is located farther away from the second inner wall relative to the first surface, the first contact portion is exposed on the first surface, the second contact portion and the third contact portion are both exposed on the second surface, a distance between the first contact portion and the second inner wall is equal to a distance between the second contact portion and the second inner wall, and the second contact portion is located closer to the second inner wall relative to the third contact portion.

In certain embodiments, the grounding member has a fourth contact portion exposed on the second inner wall to be grounded and conductively connected to the first electrical component, the third contact portion and the fourth contact portion are provided opposite to each other vertically, and a distance between the third contact portion and the fourth contact portion is greater than the distance between the first contact portion and the second inner wall.

In certain embodiments, a length of the first contact arm is greater than a length of the second contact arm, and the length of the second contact arm is greater than a length of the third contact arm.

In certain embodiments, the grounding member has a connecting portion provided above the insulating body, the second contact arm extends backward from the connecting portion, the third contact arm extends forward from the connecting portion, the insulating body has a through slot running therethrough vertically, the through slot runs downward through the first inner wall and is located below the connecting portion, and the second contact arm and the third contact arm passes downward through the through slot to be exposed on the first inner wall.

In certain embodiments, the electrical connector further includes a row of terminals, comprising a plurality of pairs of signal terminals and a plurality of ground terminals, wherein: the grounding member has a plurality of second contact arms, a plurality of third contact arms, and a plurality of connecting portions; the grounding member has a plurality of elastic portions arranged in a left-right direction, each of the elastic portions is formed by a corresponding second contact arm of the second contact arms, a corresponding third contact arm of the third contact arms, and a corresponding one of the connecting portions connecting the corresponding second contact arm and the corresponding third contact arm; and one of the pairs of signal terminals is provided between each two of the ground terminals, the first contact arm of each of the signal terminals defines a virtual extension line extending forward, and one pair of the virtual extension lines is provided between each two of the elastic portions.

In certain embodiments, the grounding member is a metal shell wrapping the insulating body, the grounding member has an upper wall provided on an upper surface of the insulating body, the upper wall has a cavity running vertically therethrough, the elastic portions are provided inside the cavity in a row, a rear surface of the cavity extends forward to form a plurality of isolating portions, the elastic portions and the isolating portions are alternately provided in the left-right direction, and each of the isolating portions connects two adjacent ones of the connecting portions.

In certain embodiments, each of the isolating portions covers one of the pairs of signal terminals from above, and a distance between two adjacent ones of the isolating portions is greater than a distance between two adjacent pairs of the pairs of signal terminals.

Compared with the related art, in the first aspect of the present invention, the insulating body has a first surface and a second surface located higher than the first surface. A first contact portion of a ground terminal is exposed on the first surface. A second contact portion and a third contact portion of the grounding member are exposed on the second surface. The second contact portion is grounded and conductively connected to the first electrical component inside the mating slot to form a first ground loop. The first contact portion is conductively connected to the first ground loop. The third contact portion and the first electrical component form a second ground loop. The third contact portion is located farther away from the second inner wall relative to both the first contact portion and the second contact portion, such that in the insertion process of the first electrical component, the portions of the first electrical component in contact with the first contact portion and the second contact portion are not in contact with the third contact portion, thereby reducing an insertion force thereof. Meanwhile, the first ground loop and the second ground loop are located at different heights in the mating slot, such that a wave peak of an electromagnetic wave of the first ground loop and a wave peak of an electromagnetic wave of the second ground loop are not superposed with each other, thereby reducing grounding resonance thereof. In addition, the first contact portion is conductively connected to the first ground loop, such that electric charges on the first contact portion are transferred to the grounding member through the first ground loop, thereby reducing the ground resonance generated in the mating slot when the ground terminal is mated with the first electrical component.

In another aspect of the present invention, the grounding member has a second contact arm and a third contact arm exposed in the mating slot to be grounded and conductively connected to the first electrical component. A length of the second contact arm and a length of the third contact arm are different, such that a wave peak of an electromagnetic wave on the second contact arm and a wave peak of an electromagnetic wave on the third contact arm are not superposed, thereby reducing the ground resonance in the mating slot.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
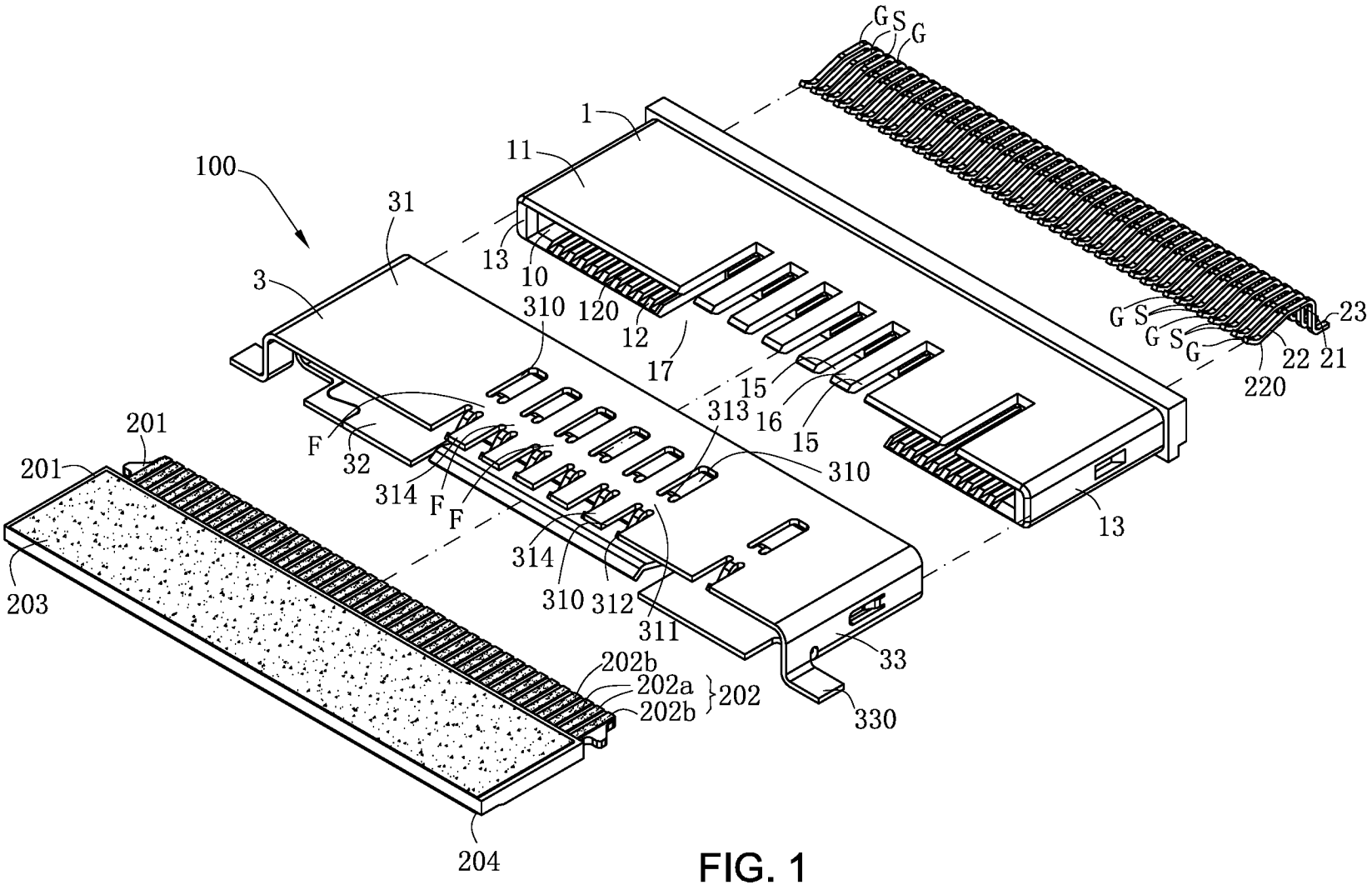
FIG. 1 is a perspective exploded view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-5. In accordance with the purposes of this invention, as embodied and broadly described herein, this invention, in one aspect, relates to an electrical connector.

Figure 2:
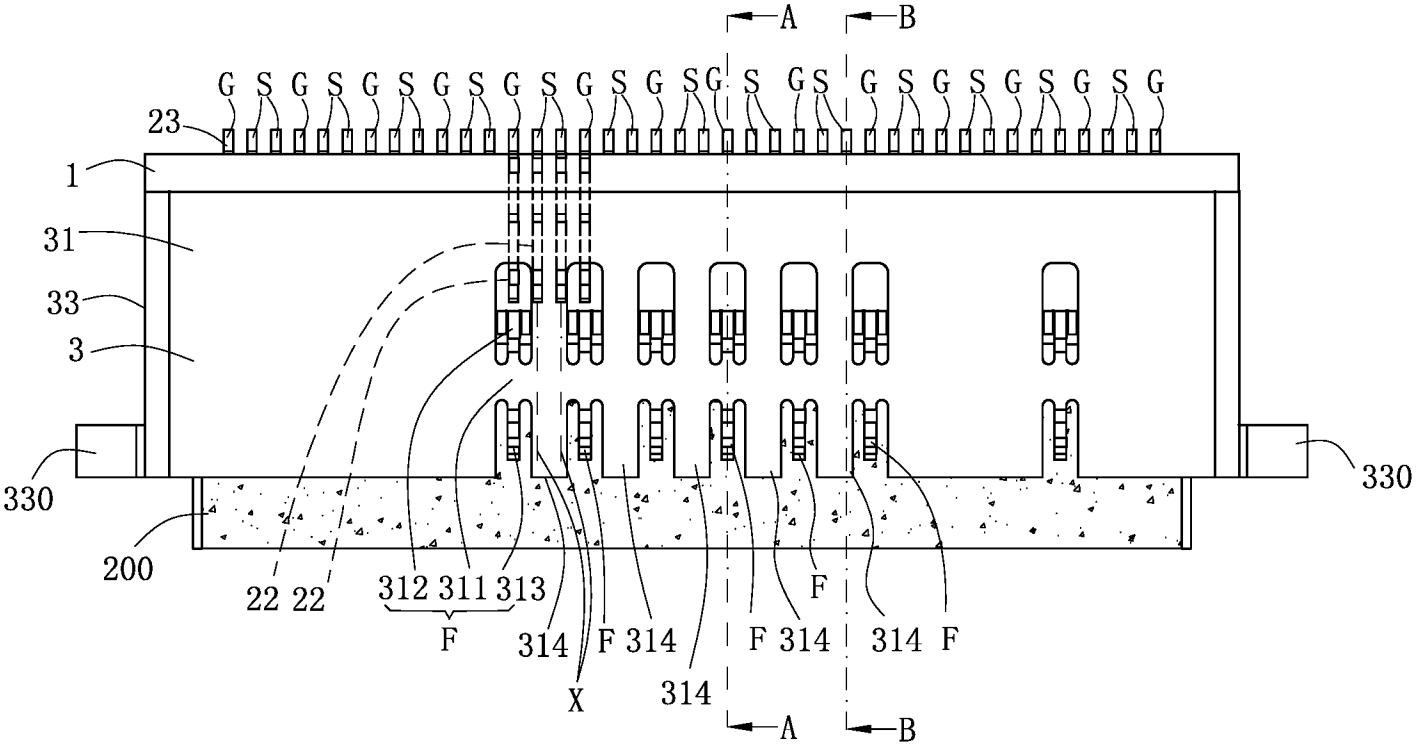
FIG. 2 is a top view of the electrical connector according to the first embodiment of the present invention.
Figure 3:
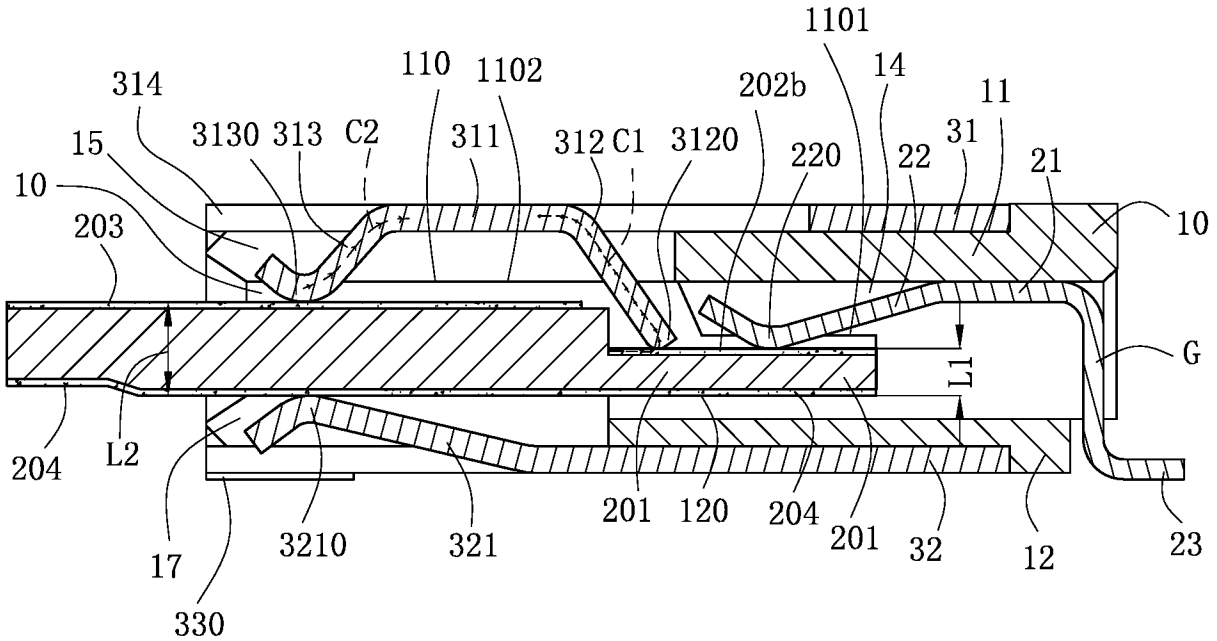
FIG. 3 is a plain sectional view of FIG. 2 taken along the A-A direction.

FIG. 1, FIG. 2, and FIG. 3 show an electrical connector 100 according to a first embodiment of the present invention. The electrical connector 100 has an insulating body 1, having a mating slot 10 opening forward to accommodate an electronic card 200. A row of terminals 2 is fixed to the insulating body 1, and a portion of each of the terminals 2 is exposed inside the mating slot 10 to be in electrical contact with the electronic card 200. Another portion of each of the terminals 2 extends backward out of the insulating body 1 to be electrically conductively connected to a circuit board (not shown in the drawings), such that the terminals 2 may transmit a signal of the electronic card 200 to the circuit board (not shown), thereby implementing a function of signal transmission. A metal shell 3 wraps the insulating body 1 for shielding.

Figure 4:
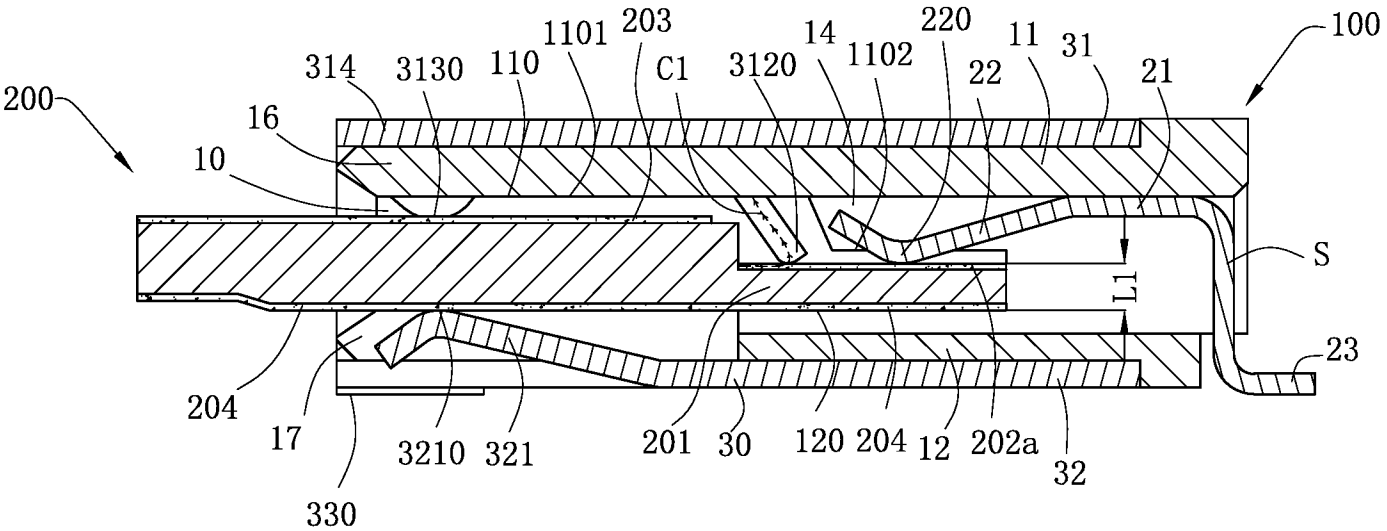
FIG. 4 is a plain sectional view of FIG. 2 taken along the B-B direction.

Referring to FIG. 1, FIG. 3, and FIG. 4, the electronic card 200 has an insertion end 201 and a row of mating contacts 202 accommodated in the mating slot 10. The row of mating contacts 202 has a plurality of pairs of signal contacts 202*a* and a plurality of ground contacts 202*b*. Each of two sides of each pair of signal contacts 202*a* is provided with one of the ground contacts 202*b*. A portion of each of the mating contacts 202 is exposed to the insertion end 201 and is in electrical contact with a corresponding terminal 2. The electronic card 200 further has a first shielding sheet 203 and a second shielding sheet 204. The row of mating contacts 202 is located between the first shielding sheet 203 and the second shielding sheet 204. The first shielding sheet 203 is located above the row of mating contacts 202 at an interval, and the second shielding sheet 204 is located below the row of mating contacts 202 at an interval. Further, a front end of the first shielding sheet 203 passes forward beyond a portion of the mating contacts 202 exposed to the insertion end 201, and a front end of the second shielding sheet 204 passes forward beyond the front end of the first shielding sheet 203 and extends to be flush with the front ends of the mating contacts 202.

Referring to FIG. 1, FIG. 3, and FIG. 4, the mating slot 10 is formed by being concavely provided on a front surface of the insulating body 1. The insulating body 1 has an upper plate 11, a lower plate 12 and two side plates 13 connecting the upper plate 11 and the lower plate 12. The upper plate 11, the lower plate 12 and the two side plates 13 surround the mating slot 10. A surface of the upper plate 11 facing the mating slot 10 forms a first inner wall 110. A surface of the lower plate 12 facing the mating slot 10 forms a second inner wall 120. The first inner wall 110 and the second inner wall 120 are provided in parallel vertically. The first inner wall 110 has a first surface 1101 and a second surface 1102. The first surface 1101 is located lower than the second surface 1102, such that the first surface 1101 is closer to the second inner wall 120. After the electronic card 200 is inserted into the mating slot 10, the mating contacts 202 and the first surface 1101 are opposite to each other vertically. The first shielding sheet 203 is accommodated in a step-shaped space formed by the first surface 1101 and the second surface 1102, and is opposite to the second surface 1102 vertically. The second shielding sheet 204 and the second inner wall 120 are opposite to each other vertically. The first surface 1101 has a plurality of terminal slots 14 arranged in a row in a left-right direction. The upper plate 11 has a plurality of through slots 15. The through slots 15 run through the upper plate 11 vertically, run forward through a front surface of the upper plate 11, and run downward through the second surface 1102. The upper plate 11 has a plurality of ribs 16, and one of the ribs 16 exists between two adjacent through slots 15. The through slots 15 and the ribs 16 are arranged in a row along the left-right direction and are alternately provided.

Referring to FIG. 1, FIG. 3, and FIG. 4, the second inner wall 120 has a notch 17. The notch 17 runs through the lower plate 12 vertically and runs forward through a front surface of the lower plate 12. The notch 17 is located below a row of the through slots 15 and a row of the ribs 16.

Referring to FIG. 1, FIG. 2, FIG. 3 and FIG. 4, the row of terminals 2 includes a plurality of pairs of signal terminals S and a plurality of ground terminals G. Each of two sides of each pair of signal terminals S has a ground terminal G. Each of the terminals 2 has a fixing portion 21 provided horizontally to be fixed to a rear end of the insulating body 1. A first contact arm 22 extends forward from the fixing portion 21 to be accommodated in a corresponding terminal slot 14. The first contact arm 22 has a first contact portion 220 protruding into the mating slot 10 to be in electrical contact with a corresponding mating contact 202. A soldering portion 23 extends backward from the fixing portion 21. The soldering portion 23 bends downward and then bends backward and extends out of the insulating body 1 to be surface-soldered to the circuit board (not shown).

Referring to FIG. 1, FIG. 2, and FIG. 3, the metal shell 3 wraps the insulating body 1. The metal shell 3 has an upper wall 31 and a lower wall 32 in parallel vertically, and two side walls 33 connecting the upper wall 31 and the lower wall 32. The upper wall 31 covers an upper surface of the upper plate 11. The upper wall 31 has a cavity 310 concavely provided backward from front thereof and a row of elastic portions F located inside the cavity 310 and arranged in a left-right direction, provided and located above the row of through slots 15. A portion of each of the elastic portions F is correspondingly accommodated in each of the through slots 15. Each of the elastic portions F has a connecting portion 311. Each of the connecting portions 311 is located above each of the through slots 15. A second contact arm 312 extends backward from each of the connecting portions 311. The second contact arm 312 passes through a corresponding through slot 15 downward from top thereof to enter the mating slot 10, and protrudes out of the second surface 1102 to form a second contact portion 3120 to be in contact with a corresponding ground contact 202*b*, thus forming a first ground loop C1 in the mating slot 10. Electric charges on the corresponding ground contact 202*b* may be transmitted to the metal shell 3 through the second contact arm 312, thereby reducing the electric charges on the corresponding ground contact 202*b*. That is, the electric charges on the first ground loop C1 are transferred out of the mating slot 10 through the first contact arm 22, thus preventing the electric charges on the first ground loop C1 from forming an interfering electromagnetic wave and affecting signal transmission. Each second contact arm 312 is located in front of the first contact arm 22 of a corresponding one of the ground terminals G at an interval. Each second contact portion 3120 and the first contact portion 220 of the corresponding one of the ground terminals G are located at a same horizontal height and jointly abut a same ground contact 202*b*, such that a potential difference of the corresponding ground contact 202*b* from the second contact portion 3120 to the first contact portion 220 is 0, thereby reducing the resonance generated when the ground contact 202*b* is mated with the terminal 2 inside the mating slot 10.

Referring to FIG. 1, FIG. 2, and FIG. 3, the row of elastic portions F is arranged at an interval in the left-right direction, such that a row of the second contact arms 312 is arranged at an interval in the left-right direction, and each of the second contact arms 312 is located in front of a corresponding ground terminal G. A length of each of the first contact arms 22 is greater than a length of each of the second contact arms 312. Two virtual extension lines X extending forward from a pair of signal terminals S are provided between each two adjacent second contact arms 312. A pair of signal contacts 202*a* is located between two adjacent second contact arms 312 and is backward in contact with a pair of signal terminals S, such that two opposite second contact arms 312 may shield the pair of signal contacts 202*a* located therebetween, thereby facilitating high-frequency performance.

Referring to FIG. 1, FIG. 2, and FIG. 3, a third contact arm 313 extends forward from each of the connecting portions 311 to be located in front of the corresponding second contact arm 312. The third contact arm 313 passes through a corresponding through slot 15 downward from top thereof to enter the mating slot 10, and protrudes out of the second surface 1102 to form a third contact portion 3130 to be in electrical contact with the first shielding sheet 203. The third contact arm 313 and the first shielding sheet 203 form a second ground loop C2 in the mating slot 10. Electric charges on the second shielding sheet 204 may be transmitted out of the mating slot 10 through the third contact arm 313, thus preventing the electric charges on the first shielding sheet 203 from forming an interfering electromagnetic wave and affecting signal transmission inside the mating slot 10. The third contact portion 3130 is located higher than a height of the second contact portion 3120. A length of the third contact arm 313 is less than the length of the second contact arm 312, such that wave peak superposition does not occur between an electromagnetic wave of the first ground loop C1 and an electromagnetic wave of the second ground loop C2 in the mating slot 10, thereby reducing the ground resonance in the mating slot 10, and reducing a signal loss occurring when the electrical connector 100 is mated with the electronic card 200. Meanwhile, a height of the third contact portion 3130 is greater than heights of the first contact portion 220 and the second contact portion 3120, such that in the insertion process of the electronic card 200, the front end of the insertion end 201 is not in contact with the third contact portions 3130, thereby reducing an insertion force thereof. In addition, each of the signal contacts 202*a* exposed on the insertion end 201 is not in electrical contact with the corresponding third contact portion 3130, thereby preventing the signal contacts 202*a* from short-circuiting. Short-circuiting may generate an excessively large instantaneous current that is sufficient to damage the performance of each signal contact 202*a*. Thus, the signal contact 202*a* can be better protected by preventing the corresponding third contact portion 3130 from being in contact with each of the signal contacts 202*a*.

Referring to FIG. 1, FIG. 2, and FIG. 3, the elastic portions F are arranged inside the cavity 310 in a row in the left-right direction at a same interval. A plurality of flat plate shaped isolating portions 314 extend forward from a rear wall surface of the cavity 310. Each of the isolating portions 314 extends forward to be located between two adjacent elastic portions F to connect the two adjacent elastic portions F, such that a same potential is maintained between the plurality of elastic portions F, thereby preventing a potential difference from being generated between the elastic portions F to form an interfering electromagnetic wave and affecting the signal transmission of the electrical connector 100. In addition, each of the ribs 16 upward supports each of the isolating portions 314, such that the isolating portions 314 are well supported, thereby facilitating the isolating portions 314 to maintain on a same horizontal plane, and enhancing the fixing effect between the metal shell 3 and the insulating body 1. Each of the isolating portions 314 is located above a pair of signal terminals S, and a distance between two adjacent isolating portions 314 is less than a distance between two adjacent pairs of signal terminals S, thereby preventing from the signal leakage caused by non-shielding above the pair of signal terminals S, and facilitating the high-frequency performance of the electrical connector 100.

Referring to FIG. 1, FIG. 2, and FIG. 3, the lower wall 32 covers a lower surface of the lower plate 12 and has a fourth contact arm 321. The fourth contact arm 321 passes through the notch 17 upward from bottom thereof to protrude out of the second inner wall 120 to form a fourth contact portion 3210 to be grounded and conductively connected to the second shielding sheet 204. The electric charges on the second shielding sheet 204 may be transferred to the metal shell 3 outside the mating slot 10 through the fourth contact arm 321, thereby reducing the interfering electromagnetic waves in the mating slot 10. The third contact portion 3130 and the fourth contact portion 3210 are provided opposite to each other vertically, and a distance L2 between the third contact portion 3130 and the fourth contact portion 3210 is less than a distance L1 between the first contact portion 220 and the second inner wall 120, such that when the insertion end 201 is inserted into the mating slot 10, each signal contact 202*a* on the insertion end 201 is not in contact with the corresponding third contact portion 3130 and the corresponding fourth contact portion 3210, and does not result in short-circuiting of the signal contacts 202*a*.

Referring to FIG. 1, FIG. 2, and FIG. 3, each of the side walls 33 is torn to form a pin 330 to be grounded and conductively connected to the circuit board (not shown), and to transfer the electric charges on the metal shell 3 to the circuit board (not shown), thereby facilitating the shielding effect of the metal shell 3.

Figure 5:
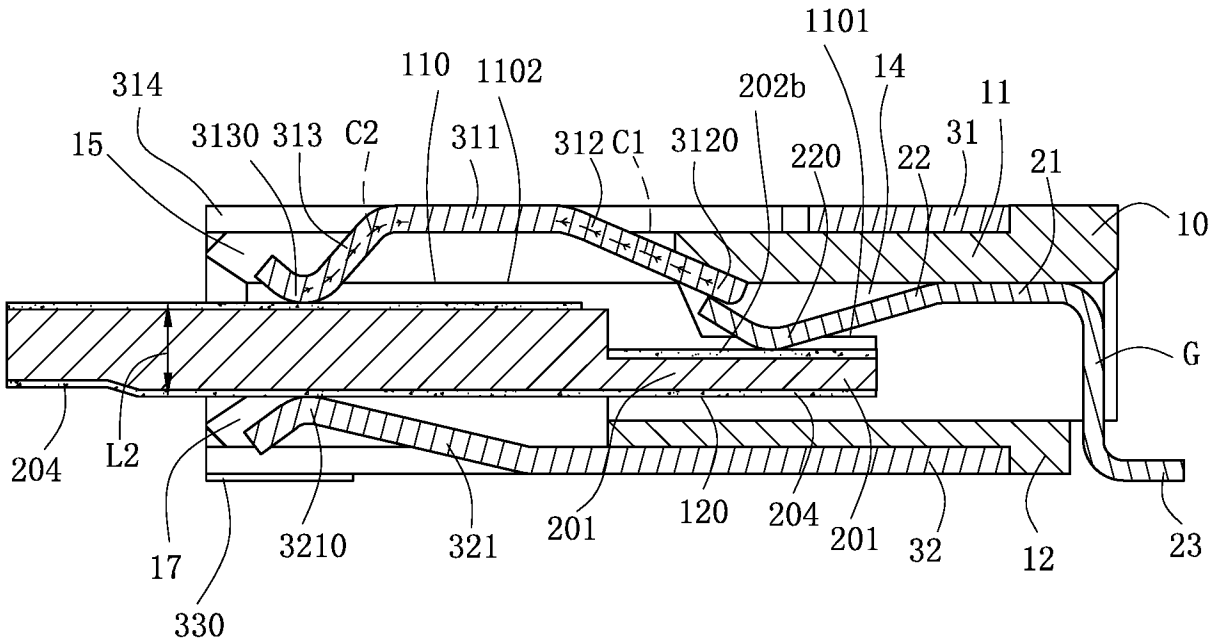
FIG. 5 is a plain sectional view of an electrical connector according to a second embodiment of the present invention.

FIG. 5 shows a second embodiment of the present invention, which is different from the electrical connector 100 of the first embodiment in that: the second contact arm 312 does not abut the ground contact 202*b*, but abuts the first contact arm 22 of the corresponding ground terminal G, thus transmitting the electric charges on the first contact arm 22 out of the mating slot 10 through the second contact arm 312, and preventing the first contact arm 22 of the corresponding ground terminal G from forming an interfering electromagnetic wave. Other structures of the electrical connector 100 of the second embodiment are identical to the corresponding structures of the electrical connector 100 of the first embodiment, and are thus not elaborated herein.

To sum up, the electrical connector according to certain embodiments of the present invention has the following beneficial effects:

1. The third contact portion 3130 is located higher than a height of the second contact portion 3120. A length of the third contact arm 313 is less than the length of the second contact arm 312, such that wave peak superposition does not occur between an electromagnetic wave of the first ground loop C1 and an electromagnetic wave of the second ground loop C2 in the mating slot 10, thereby reducing the ground resonance in the mating slot 10, and reducing a signal loss occurring when the electrical connector 100 is mated with the electronic card 200. Meanwhile, a height of the third contact portion 3130 is greater than heights of the first contact portion 220 and the second contact portion 3120, such that in the insertion process of the electronic card 200, the front end of the insertion end 201 is not in contact with the third contact portion 3130, thereby reducing an insertion force thereof. In addition, each of the signal contacts 202*a* exposed on the insertion end 201 is not in electrical contact with the corresponding third contact portion 3130, thereby preventing the signal contacts 202*a* from short-circuiting. Short-circuiting may generate an excessively large instantaneous current that is sufficient to damage the performance of each signal contact 202*a*. Thus, the signal contact 202*a* can be better protected by preventing the corresponding third contact portion 3130 from being in contact with each of the signal contacts 202*a*.

2. The second contact arm 312 passes through a corresponding through slot 15 downward from top thereof to enter the mating slot 10, and protrudes out of the second surface 1102 to form a second contact portion 3120 to be in contact with a corresponding ground contact 202*b*, thus forming a first ground loop C1 in the mating slot 10. Electric charges on the corresponding ground contact 202*b* may be transmitted to the metal shell 3 through the second contact arm 312, thereby reducing the electric charges on the corresponding ground contact 202*b*. That is, the electric charges on the first ground loop C1 are transferred out of the mating slot 10 through the first contact arm 22, thus preventing the electric charges on the first ground loop C1 from forming an interfering electromagnetic wave and affecting signal transmission.

3. Each second contact arm 312 is located in front of the first contact arm 22 of a corresponding one of the ground terminals G at an interval. Each second contact portion 3120 and the first contact portion 220 of the corresponding one of the ground terminals G are located at a same horizontal height and jointly abut a same ground contact 202*b*, such that a potential difference of the corresponding ground contact 202*b* from the second contact portion 3120 to the first contact portion 220 is 0, thereby reducing the resonance generated when the ground contact 202*b* is mated with the terminal 2 inside the mating slot 10.

4. The lower wall 32 has a fourth contact arm 321. The fourth contact arm 321 passes through the notch 17 upward from bottom thereof to protrude out of the second inner wall 120 to form a fourth contact portion 3210 to be grounded and conductively connected to the second shielding sheet 204. The electric charges on the second shielding sheet 204 may be transferred to the metal shell 3 outside the mating slot 10 through the fourth contact arm 321, thereby reducing the interfering electromagnetic waves in the mating slot 10. The third contact portion 3130 and the fourth contact portion 3210 are provided opposite to each other vertically, and a distance L2 between the third contact portion 3130 and the fourth contact portion 3210 is less than a distance L1 between the first contact portion 220 and the second inner wall 120, such that when the insertion end 201 is inserted into the mating slot 10, each signal contact 202*a* on the insertion end 201 is not in contact with the corresponding third contact portion 3130 and the corresponding fourth contact portion 3210, and does not result in short-circuiting of the signal contacts 202*a*.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, electrically connected to a first electrical component, the electrical connector comprising:

an insulating body, having a mating slot mated with the first electrical component, wherein the mating slot has a first inner wall and a second inner wall facing each other vertically, the first inner wall has a first surface and a second surface facing the second inner wall, and the first surface is located closer to the second inner wall relative to the second surface;

a ground terminal, fixed to the insulating body, and having a first contact portion exposed on the first surface; and a grounding member, fixed to the insulating body, wherein the grounding member has a second contact portion and a third contact portion both exposed on the second surface, the second contact portion is located closer to the second inner wall relative to the first surface in a vertical direction, and the third contact portion is located farther away from the second inner wall relative to the first surface in the vertical direction;

wherein the second contact portion is grounded and conductively connected to the first electrical component inside the mating slot to form a first ground loop, the first contact portion is conductively connected to the first ground loop, and the third contact portion is grounded and conductively connected to the first electrical component inside the mating slot to form a second ground loop.

2. The electrical connector according to claim 1, wherein the mating slot is forward mated with the first electrical component, the first surface is provided in front of the second surface, and the third contact portion, the second contact portion, and the first contact portion are sequentially provided at intervals in a front-rear direction.

3. The electrical connector according to claim 1, wherein the grounding member further has a fourth contact portion provided on the second inner wall, the fourth contact portion and the third contact portion are provided opposite to each other vertically inside the mating slot, and a distance between the third contact portion and the fourth contact portion is greater than a distance between the first contact portion and the second inner wall.

4. The electrical connector according to claim 1, wherein the ground terminal has a first contact arm extending forward, the first contact arm has the first contact portion, the grounding member has a second contact arm extending backward and located in front of the first contact arm correspondingly, the second contact arm has the second contact portion, and a length of the first contact arm is greater than a length of the second contact arm.

5. The electrical connector according to claim 4, wherein the grounding member has a third contact arm extending forward, the third contact arm has the third contact portion, and the length of the second contact arm is greater than a length of the third contact arm.

6. The electrical connector according to claim 5, wherein the grounding member has a connecting portion provided above the insulating body, the second contact arm extends backward from the connecting portion, the third contact arm extends forward from the connecting portion, the insulating body has a through slot running vertically therethrough and running downward through the first inner wall, the through slot is located below the connecting portion, and the second contact arm and the third contact arm passes downward through the through slot to be exposed on the second surface.

7. The electrical connector according to claim 6, further comprising a row of terminals, comprising a plurality of pairs of signal terminals and a plurality of ground terminals, wherein:

the grounding member has a plurality of second contact arms, a plurality of third contact arms, and a plurality of connecting portions;

the grounding member has a plurality of elastic portions arranged in a left-right direction, each of the elastic portions is formed by a corresponding second contact arm of the second contact arms, a corresponding third contact arm of the third contact arms, and a corresponding one of the connecting portions connecting the corresponding second contact arm and the corresponding third contact arm; and one of the ground terminals is provided behind each of the elastic portions, and a virtual extension line extending forward from one of the signal terminals is provided between each two of the elastic portions.

8. The electrical connector according to claim 7, wherein the grounding member is a metal shell wrapping the insulating body, the grounding member has an upper wall provided on an upper surface of the insulating body, the upper wall has a cavity running vertically therethrough, the elastic portions are provided inside the cavity in a row, a rear surface of the cavity extends forward to form a plurality of isolating portions, the elastic portions and the isolating portions are alternately provided in the left-right direction, and each of the isolating portions connects two adjacent ones of the connecting portions.

9. The electrical connector according to claim 8, wherein each of the isolating portions covers one of the pairs of signal terminals from above, and a distance between two adjacent ones of the isolating portions is less than a distance between two adjacent pairs of the pairs of signal terminals.

10. An electrical connector, electrically connected to a first electrical component, the electrical connector comprising:

an insulating body, having a mating slot opening forward to accommodate the first electrical component, wherein the mating slot has a first inner wall;

a ground terminal, fixed to the insulating body and having a first contact arm partially exposed on the first inner wall to be grounded and conductively connected to the first electrical component; and a grounding member, fixed to the insulating body, wherein the grounding member has a second contact arm and a third contact arm both partially exposed on the first inner wall to be grounded and conductively connected to the first electrical component, the second contact arm and the third contact arm are provided in front relative to the first contact arm, and a length of the second contact arm is different from a length of the third contact arm.

11. The electrical connector according to claim 10, wherein the first contact arm has a first contact portion, the second contact arm has a second contact portion, the third contact arm has a third contact portion, each of the first contact portion, the second contact portion and the third contact portion is grounded and conductively connected to the first electrical component, the first contact portion and the second contact portion are located on a same horizontal plane, and the second contact portion and the third contact portion are located on different horizontal planes.

12. The electrical connector according to claim 11, wherein the mating slot further has a second inner wall, the first inner wall and the second inner wall are provided to face each other in a vertical direction, the first inner wall has a first surface and a second surface facing the second inner wall, the second surface is located farther away from the second inner wall relative to the first surface, the first contact portion is exposed on the first surface, the second contact portion and the third contact portion are both exposed on the second surface, a distance between the first contact portion and the second inner wall is equal to a distance between the second contact portion and the second inner wall, and the second contact portion is located closer to the second inner wall relative to the third contact portion.

13. The electrical connector according to claim 12, wherein the grounding member has a fourth contact portion exposed on the second inner wall to be grounded and conductively connected to the first electrical component, the third contact portion and the fourth contact portion are provided opposite to each other vertically, and a distance between the third contact portion and the fourth contact portion is greater than the distance between the first contact portion and the second inner wall.

14. The electrical connector according to claim 11, wherein a length of the first contact arm is greater than a length of the second contact arm, and the length of the second contact arm is greater than a length of the third contact arm.

15. The electrical connector according to claim 11, wherein the grounding member has a connecting portion provided above the insulating body, the second contact arm extends backward from the connecting portion, the third contact arm extends forward from the connecting portion, the insulating body has a through slot running therethrough vertically, the through slot runs downward through the first inner wall and is located below the connecting portion, and the second contact arm and the third contact arm passes downward through the through slot to be exposed on the first inner wall.

16. The electrical connector according to claim 15, further comprising a row of terminals, comprising a plurality of pairs of signal terminals and a plurality of ground terminals, wherein:

the grounding member has a plurality of second contact arms, a plurality of third contact arms, and a plurality of connecting portions;

the grounding member has a plurality of elastic portions arranged in a left-right direction, each of the elastic portions is formed by a corresponding second contact arm of the second contact arms, a corresponding third contact arm of the third contact arms, and a corresponding one of the connecting portions connecting the corresponding second contact arm and the corresponding third contact arm; and one of the pairs of signal terminals is provided between each two of the ground terminals, the first contact arm of each of the signal terminals defines a virtual extension line extending forward, and one pair of the virtual extension lines is provided between each two of the elastic portions.

17. The electrical connector according to claim 16, wherein the grounding member is a metal shell wrapping the insulating body, the grounding member has an upper wall provided on an upper surface of the insulating body, the upper wall has a cavity running vertically therethrough, the elastic portions are provided inside the cavity in a row, a rear surface of the cavity extends forward to form a plurality of isolating portions, the elastic portions and the isolating portions are alternately provided in the left-right direction, and each of the isolating portions connects two adjacent ones of the connecting portions.

18. The electrical connector according to claim 17, wherein each of the isolating portions covers one of the pairs of signal terminals from above, and a distance between two adjacent ones of the isolating portions is greater than a distance between two adjacent pairs of the pairs of signal terminals.

* * * * *